US011234895B2

(12) United States Patent
Brouse

(10) Patent No.: US 11,234,895 B2
(45) Date of Patent: Feb. 1, 2022

(54) HEATING AND VIBRATING PERSONAL MASSAGER WITH INTERCHANGEABLE DETACHABLE SHELLS AND ACCOMPANYING HAND COVERLET

(71) Applicant: Getting in the Mood, LLC, Akron, OH (US)

(72) Inventor: Beverly Brouse, Akron, OH (US)

( * ) Notice: Subject to any disclaimer, the term of this patent is extended or adjusted under 35 U.S.C. 154(b) by 471 days.

(21) Appl. No.: 16/399,303

(22) Filed: Apr. 30, 2019

(65) Prior Publication Data

US 2019/0254923 A1 Aug. 22, 2019

Related U.S. Application Data

(63) Continuation-in-part of application No. 14/568,345, filed on Dec. 12, 2014, now abandoned.

(51) Int. Cl.

| | |
|---|---|
| ***A61H 19/00*** | (2006.01) |
| ***A61H 23/02*** | (2006.01) |
| ***A61H 1/00*** | (2006.01) |

(52) U.S. Cl.

CPC ..... *A61H 23/0263* (2013.01); *A61H 1/00* (2013.01); *A61H 19/34* (2013.01); *A61H 2201/0153* (2013.01); *A61H 2201/0207* (2013.01); *A61H 2201/1654* (2013.01); *A61H 2201/1697* (2013.01); *A61H 2201/5035* (2013.01)

(58) Field of Classification Search

CPC ..... A61H 19/00; A61H 19/30; A61H 19/34; A61H 19/50

See application file for complete search history.

(56) References Cited

U.S. PATENT DOCUMENTS

| | | | |
|---|---|---|---|
| 4,577,625 | A | 3/1986 | Lohati et al. |
| 5,460,597 | A | 10/1995 | Hopper |
| 6,599,236 | B1 | 7/2003 | Castro |
| 6,748,604 | B2 | 6/2004 | Duboff et al. |
| 7,938,789 | B2 | 5/2011 | Imboden et al. |

(Continued)

FOREIGN PATENT DOCUMENTS

| | | | |
|---|---|---|---|
| CN | 203208321 | U | 9/2013 |
| CN | 203329009 | U | 12/2013 |

OTHER PUBLICATIONS http://www.aliexpress.com/store/group/Jump-Tiaodan/1 111084_254201802.html.

(Continued)

*Primary Examiner* — LaToya M Louis

(74) *Attorney, Agent, or Firm* — Brian Harrod; George W. Moxon, II

(57) ABSTRACT

A hand-held, non-penetrating, non-phallic shaped apparatus for clitoral massage and stimulation comprising a massager housing having a generally prolate spheroid shape sized to fit entirely within a user's palm leaving a user's fingers free, generally convex top and bottom, first and second convex ends, a power source; a vibrating source contained within the massager housing providing at least one level of vibration; at least one switch for activating said vibration; a generally elliptical three-dimensional concave depression on a surface of the convex top of one of said convex ends of sufficient length, width, and depth for enveloping and facilitating the stimulation of a woman's clitoris and labia; wherein when in use the apparatus is held by the bottom.

12 Claims, 15 Drawing Sheets

(56) References Cited

U.S. PATENT DOCUMENTS

| | | | | |
|---|---|---|---|---|
| 9,314,400 | B1 | 4/2016 | Dudley | |
| 2003/0181784 | A1 | 9/2003 | Klein | |
| 2004/0087881 | A1 | 5/2004 | Gross | |
| 2007/0255187 | A1 | 11/2007 | Branch | |
| 2009/0247915 | A1 | 10/2009 | Imboden et al. | |
| 2011/0257473 | A1 | 10/2011 | Torla | |
| 2012/0220907 | A1* | 8/2012 | Zinn | A61H 19/34 601/46 |
| 2013/0053630 | A1 | 2/2013 | Wail et al. | |
| 2013/0116503 | A1 | 5/2013 | Mertens et al. | |
| 2013/0331745 | A1 | 12/2013 | Sedic | |
| 2014/0018612 | A1* | 1/2014 | Lin | A61H 11/00 600/38 |
| 2014/0066925 | A1 | 3/2014 | Howard | |
| 2014/0275759 | A1* | 9/2014 | Lee | A61H 23/00 600/38 |
| 2015/0320636 | A1 | 11/2015 | Fine et al. | |

OTHER PUBLICATIONS http://www.aliexpress.com/popular/deux.html.
http://www.aliexpress.com/item/1X-Five-Finger-Full-Body-Pulsating-Vibrating-Magic-Massage-Glove-J1448/1324487997.html.
http://www.mysecretluxury.com/toys-gadgets/luxury-vibrators/clitoral-vibrators/jimmyjane-form-3-vibrator.
http://www.mysecretluxury.com/toys-gadgets/luxury-vibrators/clitoral-vibrators/we-vibe-touch-vibrator.
Isaacson, Andy, "Can a Better Vibrator Inspire an Age of Great American Sex?", The Atlantic Monthly, 2012.

* cited by examiner

HEATING AND VIBRATING PERSONAL MASSAGER WITH INTERCHANGEABLE DETACHABLE SHELLS AND ACCOMPANYING HAND COVERLET

CROSS REFERENCE TO RELATED APPLICATIONS

This application is a continuation-in-part of, and claims the benefit of, U.S. patent application Ser. No. 14/568,345, filed on Dec. 12, 2014, which is entitled "Heating and Vibrating Personal Massager with Accompanying Cover" and is incorporated herein by reference.

BACKGROUND OF INVENTION

Personal massagers, also known as vibrators, are well known in the art. They come in a variety of shapes and sizes, perform different functionalities and operate on different power sources. What they all have in common, however, are their characteristics of being cold, one directional (in function and texture), hard, and lacking discretion in design. These marks hold true despite the many developments in shape, texture, color and strength. Prior art lacks (1) the designs that specifically mirror the female's external anatomy for maximizing pressure points, (2) the ability to offer customized fittings by way of interchangeable tops, and (3) the versatility in textiles and textures. As seen in U.S. patent application Ser. No. 14/018,070, textured surfaces with various patterns are not new to the art but the ability to provide customizable attachments and varying interchangeable textiles is an element not yet available.

Although heating features have been introduced, prior art (exclusively for sexual stimulation) shows only gloves or cylinder shaped massagers such as dildos and bullets which are designed for insertion or penetration, have incorporated heating elements (U.S. patent application Ser. Nos. 09/712,663 & 10/128,669). Prior art designed specifically for external stimulation lacks the element of instant localized heat and the use of interchangeable tops for activation of power source.

US Patent Application Publication No. 2014/0066925 by Howard teaches a textured glove that houses a vibration unit for external stimulation. The application also discloses a two part glove system with an outer and inner portion that can be separated for washing. Additionally, the outer glove configuration is disclosed to be usable with lubricants. This application does not teach a vibration unit that is capable of being used separately from the glove, and likewise does not disclose many of the features of such a unit.

U.S. Pat. No. 6,748,604 to Duboff et al. teaches a glove that includes massage elements in each of the fingertips of the glove. Each massage element includes a housing and a motor therein for vibrating the housing, a power source, such as a conventional or rechargeable battery, may be provided for powering the motors. Each massage element is electronically connected to the power source, and a securing means may be provided for securing the device to the hand of a user. This reference does not teach a separate outside accessible opening for purpose of holding a separate massager unit. Likewise, this application does not teach interchangeable and removable textiles to be adhered to outside of coverlet.

US Patent Application Publication No. 2013/0116503 by Mertens et al. teaches an egg shaped unit with a thin end, a wide end, buttons to control variable speed settings, and is constructed out of plastic or silicone. This application also discloses a suction feature, a textured contact surface and being usable with lubricants. This reference does not teach use of a textile coverlet or its features. Likewise, this reference does not teach interchangeable and removable shells.

US Patent Application Publication No. 2013/0053630 by Wail et al. teaches a vibration unit having a heating element internal to the vibration unit. This reference does not teach a textile coverlet or its components. Likewise, this reference does not teach interchangeable and removable shells.

U.S. Pat. No. 7,938,789 to Imboden et al. teaches a massager with mating recharging base. It can be controlled via remote control, can be used with lubricants, and is fluid- and water-resistant. This reference does not teach any sort of textile coverlet or its features. Likewise, this reference does not teach any sort of interchangeable and removable shells.

U.S. Pat. No. 6,599,236 to Castro teaches a dildo having a heating element within the shaft. The device is non-vibrating and requires insertion/penetration. This reference does not teach a textile coverlet or its components. Likewise, this reference does not teach interchangeable and removable shells.

US Patent Application Publication No. 2004/0087881 by Gross teaches a vibrating, heated leather glove. The glove operates on electricity obtained from conventional wall sockets (heating element) and a 2-AA battery powered massage motor. This reference does not teach a separate outside accessible opening for purpose of holding a separate massager unit. Likewise, this application does not teach interchangeable and removable textiles to be adhered to outside of coverlet.

US Patent Application Publication No. 2013/0331745 by Sedic teaches a personal massager and can also include a controller for controlling the operation of the massager. The massager includes a motor and can also include a wireless remote control that can include a motion sensor/accelerometer) for detecting motion of the controller (e.g., changes in orientation). The through-put motor power, a vibration pattern, or another massage setting are adjusted based on the detected motion of the controller or massager. This reference does not teach a textile coverlet or its components. Likewise, this reference does not teach any sort of interchangeable and removable shells.

Chinese applications CN 203208321 U and CN 203329009 U teach a egg-shaped vibrators connect to an external power source and control. '321 teaches controlling the egg using a controller attached the device. The device can also play music while in use. '009 teaches controlling the egg using a mobile phone with a wired connection to the egg. Neither teach any kind of textile coverlet. Likewise, neither reference teaches any sort of interchangeable and removable shells.

Prior art teaches vibrators/massagers that are cylinder or phallic shaped, have an average length between 6-9 inches, and a diameter of 2 to 3 inches are generally intended for insertion or penetration into the body.

The inventor came up with the invention while seeking help from a sexual health therapist, because, like many women her age, the inventor found herself struggling with her libido. Although she deeply loved her husband, she couldn't figure out why her desire for intimacy was nearly depleted. All she knew was her lack of sexual interest had caused a strain not only on her marriage. She learned how oral contraception, anti-anxiety medication and fatigue all play a role in stifling ones sex drive.

Suspecting her hang-ups may be more than just physical, the inventor reached out to a sexual health therapist. Therapy revealed her religious upbringing inadvertently contributed to her current view on sex and associated feelings of guilt and shame. She also realized that sex was no longer a priority. Like many working mothers, sex had become just another chore on her to-do list. Finding herself being turned off by traditional adult toys, her search left her empty-handed. Her religious upbringing had caused her to associate the feelings of shame and guilt with the act of self-pleasure. Challenged to find a way to overcome these negative feelings, the inventor conceptualized an apparatus that offered instant warmth, softness and a form of visual concealment during the act of self-pleasure.

Vibrators, on their own, regardless of shape or size carry with them, in more conservative communities, a negative social stigma and indiscretion that some women find difficult to overcome. The present invention offers a conservative and innovative alternative for meeting the needs of those women turned off by traditional designs and functionality of prior art.

SUMMARY OF INVENTION

The present invention relates to a hand-held, non-penetrating, non-phallic shaped apparatus for clitoral massage and stimulation comprising a massager housing having a generally prolate spheroid shape sized to fit entirely within a user's palm leaving a user's fingers free, generally convex top and bottom, first and second convex ends, a power source; a vibrating source contained within the massager housing providing at least one level of vibration; at least one switch for activating said vibration; a generally elliptical three-dimensional concave depression on a surface of the convex top of one of said convex ends of sufficient length, width, and depth for enveloping and facilitating the stimulation of a woman's clitoris and labia; wherein when in use the apparatus is held by the bottom.

BRIEF DESCRIPTION OF THE DRAWINGS

These and other objects and features of the present invention will become apparent to the reader through a consideration of the Detailed Description of the Invention when considered in conjunction with the drawing figures in which.

DETAILED DESCRIPTION OF INVENTION

Figure 1:
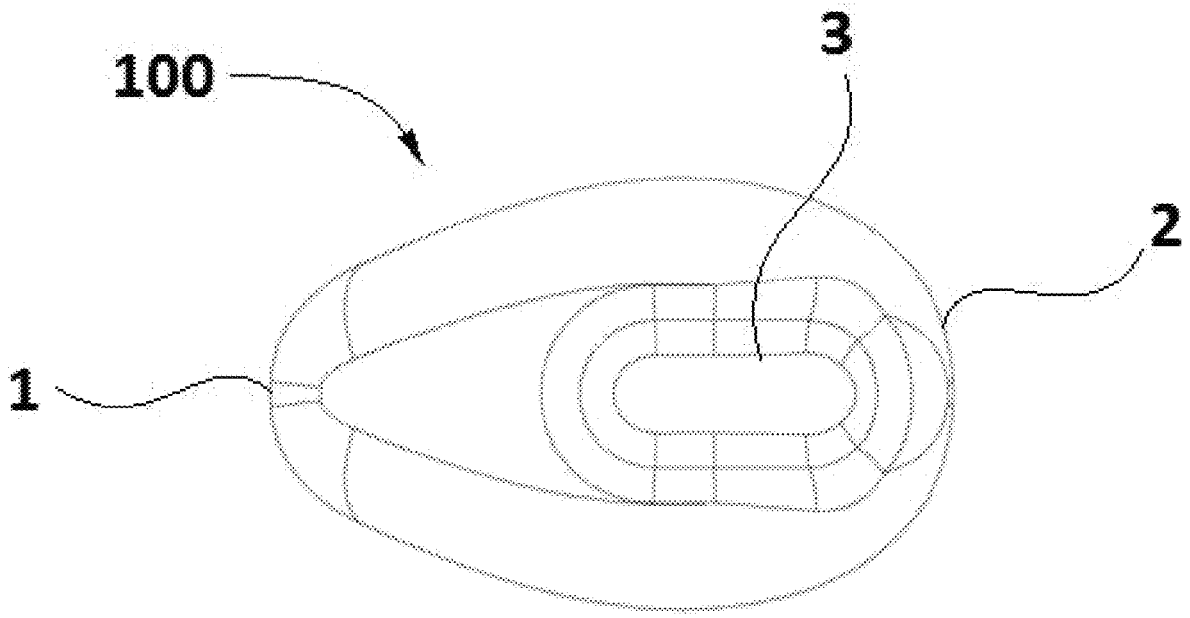
FIG. 1 is a top view of the massager base apparatus invention.

The present invention provides a new and improved non-penetrating, non-phallic shaped, hand-held personal massager for clitoral massage and stimulation comprising: a massager housing having a generally prolate spheroid shape sized to fit entirely within a user's palm, generally convex top and bottom, first and second convex ends, a power source; at least one switch; a vibrating source contained within the massager housing providing at least one level of vibration; a generally elliptical three-dimensional concave depression on a surface of said housing of sufficient depth for enveloping a woman's clitoris and labia; and wherein when in use, the apparatus is held in the palm of the hand, leaving a user's fingers free.

The design allows for multi-functionality by use of interchangeable semi-rigid silicone shells that provide an array of varying pressure points designed for accommodating the different shapes and sizes of the female's external anatomy. The term "semi-rigid" is intended to mean that the material retains its shape (i.e. it does not sag due to gravity), but can bend, flex, and/or deform when pressure or force is applied to it, and it will return to its original shape when the force/pressure is removed. The accompanying hand coverlet conceals the hand while providing instant warmth and possible mental disassociation with the act of masturbation. When used together, the massager, along with one of its interchangeable shells and hand coverlet offers a soft, discreet and more sophisticated twist over traditional massagers.

In accordance with one embodiment of the invention there is a massager base apparatus, comprising: a massager housing; a power source compartment contained within the massager housing; processor board with micro controller contained within the massager housing connected to power source compartment, only activated when connected to a silicone molded shell, for controlling heating and vibration; a motor and weight contained within the massager housing connected to processor board with micro controller connected to the power source compartment, only activated when connected to a silicone molded top, for providing vibration activated by outside controls in the form of buttons; heater boards within the massager housing connected to processor board with micro controller connected to the power source compartment, only activated when connected to a silicone molded shell, for providing heat to a centralized location of the massager base at the elliptical stimulation depression. The heat is activated automatically once silicone shell attaches to massager base.

In the second embodiment of the invention there are interchangeable attachable/detachable shells or tops, comprising; a collection of semi-rigid molds made of silicone. Each molded shape uniquely designed with specific pressure points for providing maximum intensity against varying female anatomy shapes and sizes. More specifically, each of the molded interchangeable shells are designed as parallel opposites/compliments to the most common female's external anatomy sizes. Three possible examples are herein described as one of three variations; tight, average/medium, and loose.

In another embodiment of the invention there is a textile hand coverlet, comprising; a cloth cover designed to fit over the hand with inside access to massager base with attached shell apparatus; a built-in pocket specifically designed for the massager base with attached shell apparatus is constructed within the cloth textile cover; defined pattern of textile affixed on outside palm of cover positioned directly over built-in pocket which holds the massager base with attached shell apparatus.

There is provided herein a new and improved non-penetrating, non-phallic shaped hand-held, vibrating and warming massager accompanied with interchangeable silicone shells and a cloth textile hand coverlet. The device is designed for stimulation of the external erogenous zones (e.g. the clitoris) and not for internal use (i.e. penetration of the vagina). Unlike traditional vibrators, which are phallic shaped, and are significantly longer than they are wide, the present invention is shorter and wider; it is generally ovoid (i.e. ellipsoid, or egg-shaped). The term "non-penetrating" is intended to mean that, due to its ovoid shape, the length of the longest dimension of the device is approximately twice the width of the greatest diameter of a cross-section taken perpendicular to its longest dimension. In other words, it's approximately twice as long as it is wide (measured at its widest). In contrast, most traditional vibrators are phallic shaped, and 3-4 times (at least) longer than they are wide.

The device is sized and shaped to fit in the palm of the hand. More specifically, it is designed to be cupped and held in the palm of the hand. Moreover, the device is generally a prolate spheroid (or prolate ellipsoid of revolution, i.e. a 3-dimensional shape formed from an ellipse rotated about its major axis), or egg-shaped. More specifically, the device resembles a common household wireless computer mouse, but having a rounded bottom surface instead of the typical flat bottom of a mouse. It is designed to be inconspicuous, and to be dissimilar to other vibrators or "sex toys"; it is intentionally designed not to resemble a penis or have a phallic shape. Additionally, the interchangeable silicone shells are designed for customized fit to the female's external anatomy.

The vibrating and warming massager base includes an internally contained motor, processor board, and two heater boards in which all are powered by an internal DC power source (e.g. rechargeable lithium battery or standard batteries (e.g. three (3) AA batteries)) housed in a battery compartment whose power is activated only when an interchangeable shell is attached. Use of active noise control/sound wave technology (i.e. noise-cancelling) or high pitched frequency can be incorporated to significantly reduce or eliminate noise caused by motor without compromising strength of vibration. Coated with or molded from a thin, bio-compatible silicone, the massager's inside components are protected from moisture, water, and/or lubricants by the protective silicone finish. A thin barrier is present directly above the heater board, within the massager base, for concentrated heat within the centered depression while also enabling connectivity and a built in safety feature that is part of an interchangeable silicon shell 200. (See FIG. 8). The interchangeable silicone shells include the parallel opposites or inverted designs reflective of common variations of female external anatomy shape and size. The preferred variations in the shapes and sizes of silicone shells are identified generally as tight, typical/average, and loose, with the idea to add additional varying sizes to maximize force of pressure points. The preferred embodiment uses a combination of silicone, plastic and heat conductor. The textile hand coverlet is made from breathable, high quality, and machine washable materials that are surged together for sturdy construction and lasting durability. The hand coverlet can be a glove, a sleeve, a mitten, and/or a mitt. A preferred embodiment uses a fingerless mitt, large enough to encompass the vibrating device and a woman's hand. As used herein, examples and illustrations are exemplary in nature and not intended to be limiting.

Vibrating & Heating Massager

Figure 1A:
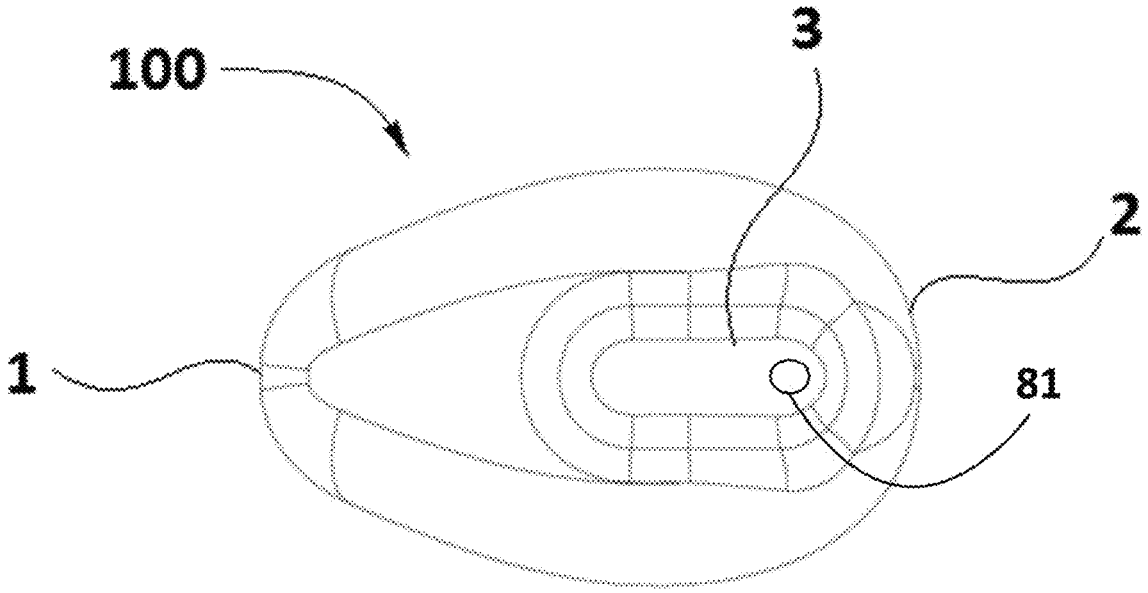
FIG. 1A is an alternate embodiment of the massager shown in FIG. 1.
Figure 4:
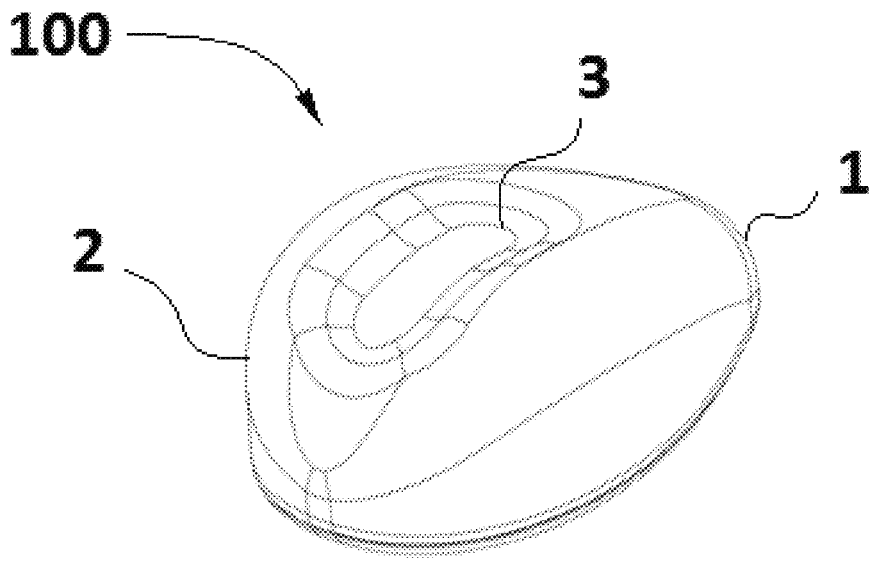
FIG. 4 is a perspective view of the massager base apparatus.
Figure 4A:
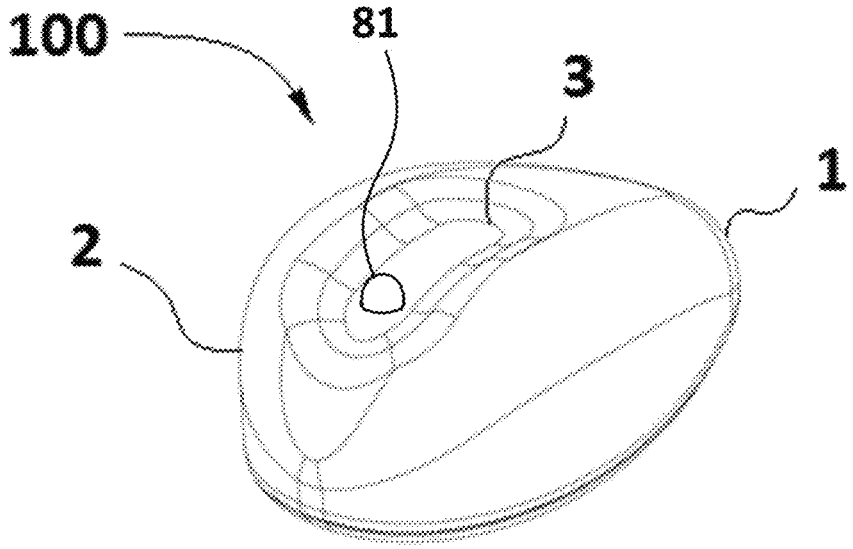
FIG. 4A is an alternate embodiment of the massager shown in FIG. 4.

With reference to FIGS. 1-7, there is shown a new and improved non-penetrating, non-phallic shaped, ovoid vibrating and heating personal massager base 100 measuring between 2 to 5 inches in length and 1.5 to 3 inches in width, preferably 3.7 inches in length and 1.9 inches in width. It is sized to fit comfortably and entirely within the palm of the hand, leaving the user's hands free to manipulate the controls on the device and/or digital/manual self-stimulation. It features a smooth narrow end 1 and a wide end 2 shaped with a vertical concave cup or depression 3. An alternate embodiment is shown in FIGS. 1A, and 4A where the design further comprises a stimulating bump/knob 81 disposed in the valley of the depression 3.

Figure 5:
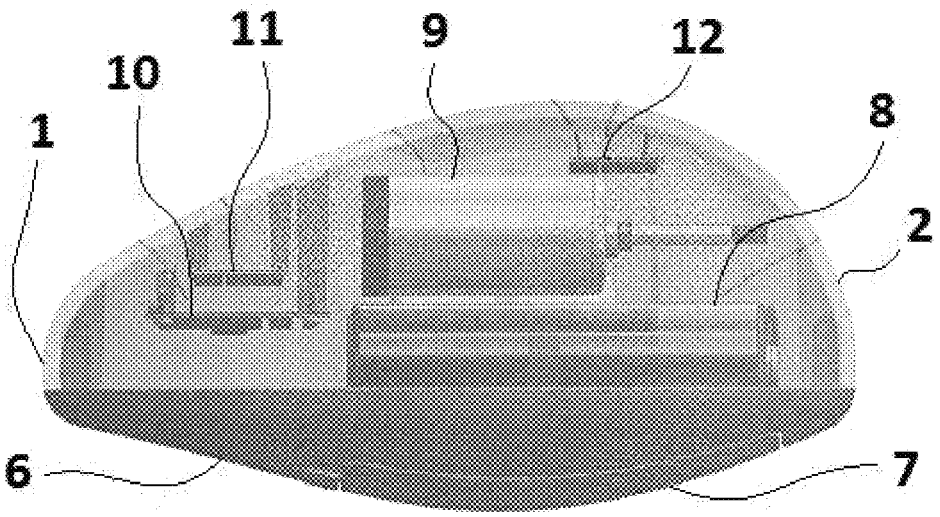
FIG. 5 is a partial cross section of the massager base apparatus.
Figure 6:
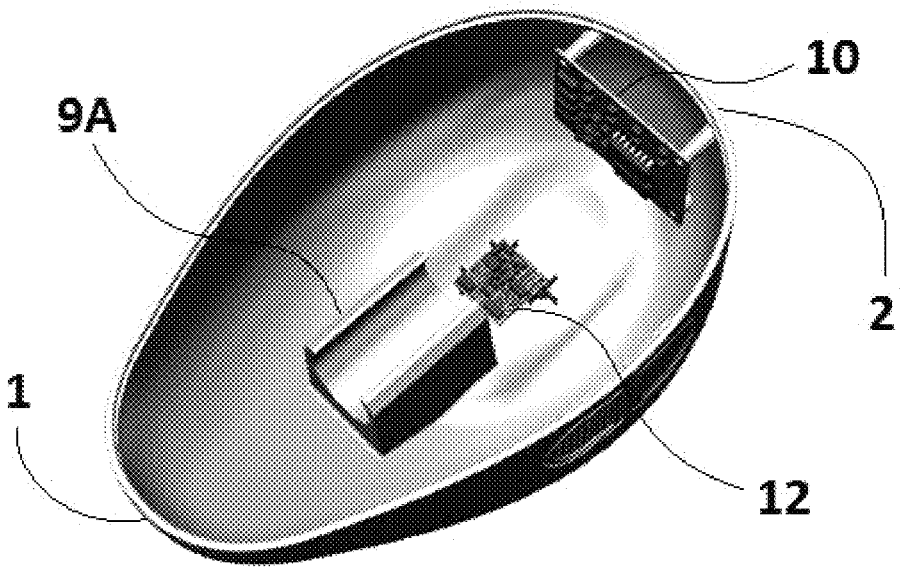
FIG. 6 is a partial exploded view of the top portion of the massager base apparatus.
Figure 7:
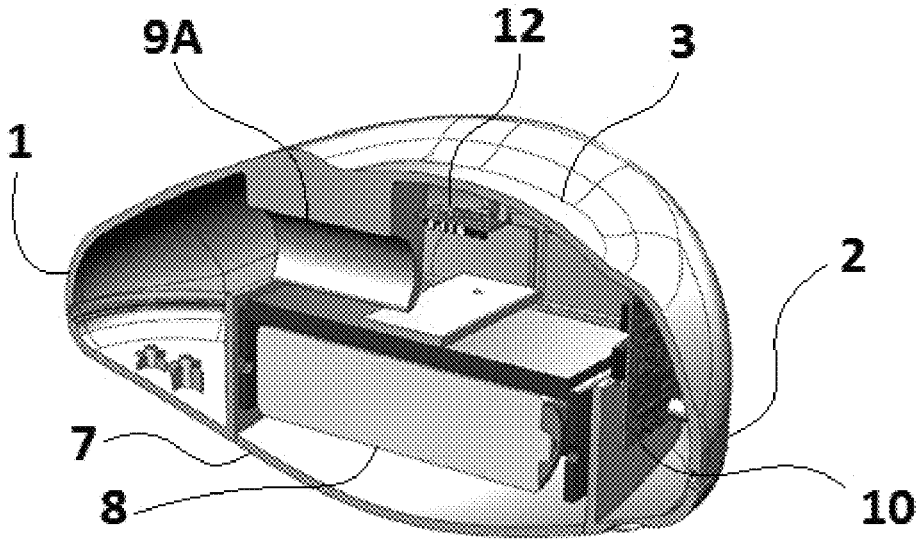
FIG. 7 is a partial cross section of the massager base.

The wide end 2 houses the heater board 12, as will be further discussed in FIGS. 5, 6 and 7, as well as a processor board 10 and motor 9. An additional heater board 11 may also be located in the narrow end 1 for distributing even heat throughout the device but is not critical in the design, as seen in FIG. 5. The figure also shows a single motor, but the motor is not critical, and can be a single motor or a plurality of motors. A preferred embodiment features one vibrating motor located directly under the center depression 3 of the massager base 100. The use of sound wave technology or another sound diminishing technique (i.e. active noise control/noise-cancelling technology) can be used to significantly reduce or eliminate the noise or sound of the motor without compromising the strength of vibration. This preference to minimize or eliminate sounds due to strong vibration fits with the inventor's mission to achieve a discreet and inconspicuous art.

Further incorporated within the massager base 100 are the controls, in the form of preferably one button, but can be two or more buttons 4, 5 preferably mirrored on both sides, but could be positioned on only one side. The buttons 4, 5 are visible and operable through the protective coating. An alternate embodiment includes a dial or knob or other analog control means to set the vibration at any level between 10% and 100% duty cycle.

Figure 2:
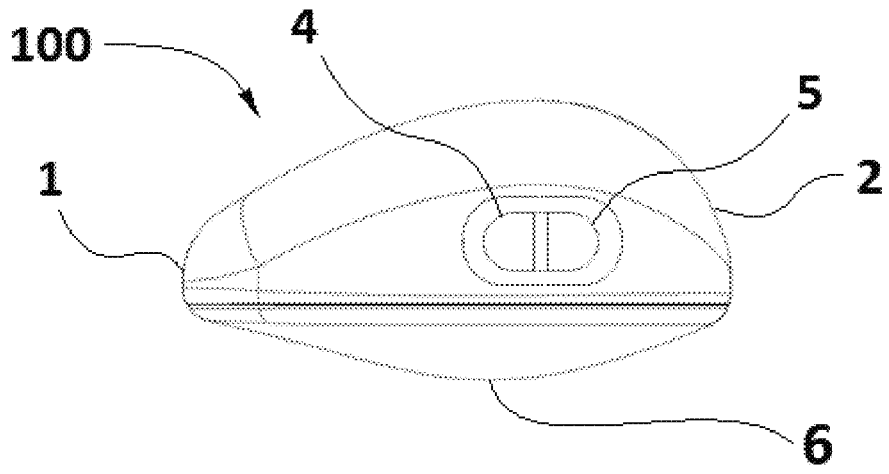
FIG. 2 is a side view of the massager base apparatus.
Figure 3:
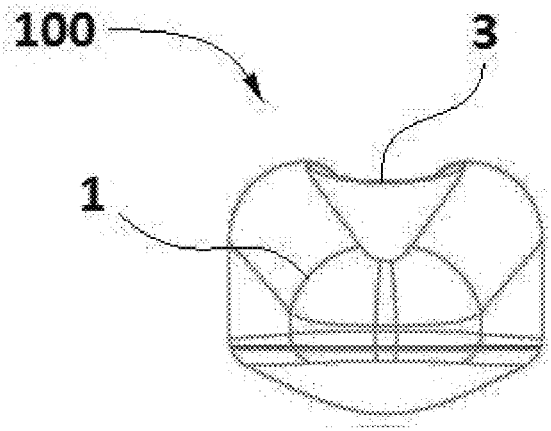
FIG. 3 is a front view of the massager base apparatus.

With reference to FIG. 2 (see also, FIG. 9), either button 4, 5 operates the vibrating feature whose strength is governed by a battery powered motor and counter weight 9 connected to processor board 10 with a micro controller. The vibration means provides at least 1 level of vibration, with three distinct levels being preferred, and more than three being possible. The levels of vibration are tied to duty cycle. The term "duty cycle" is intended to mean the percentage of one period in which a signal is active. A period is the time it takes for a signal to complete an on-and-off cycle. As a formula, a duty cycle may be expressed as:

$$D=t/P\times 100\%$$

where D is the duty cycle, t is the time the signal is active, and P is the total period of the signal. Thus, for example, a 60% duty cycle means the signal is on 60% of the time but off 40% of the time. The "on time" for a 60% duty cycle could be a fraction of a second, a day, or even a week, depending on the length of the period.

In the case of the present invention, three levels of vibration intensity are preferred, low, medium, and high. The low setting uses a 10-30% duty, where the time the signal is active (t) is between 0.050 ms-0.200 ms. The medium setting uses a 30-60% duty cycle with t between 0.200-0.400 ms. The high setting uses 100% duty cycle.

Figure 9:
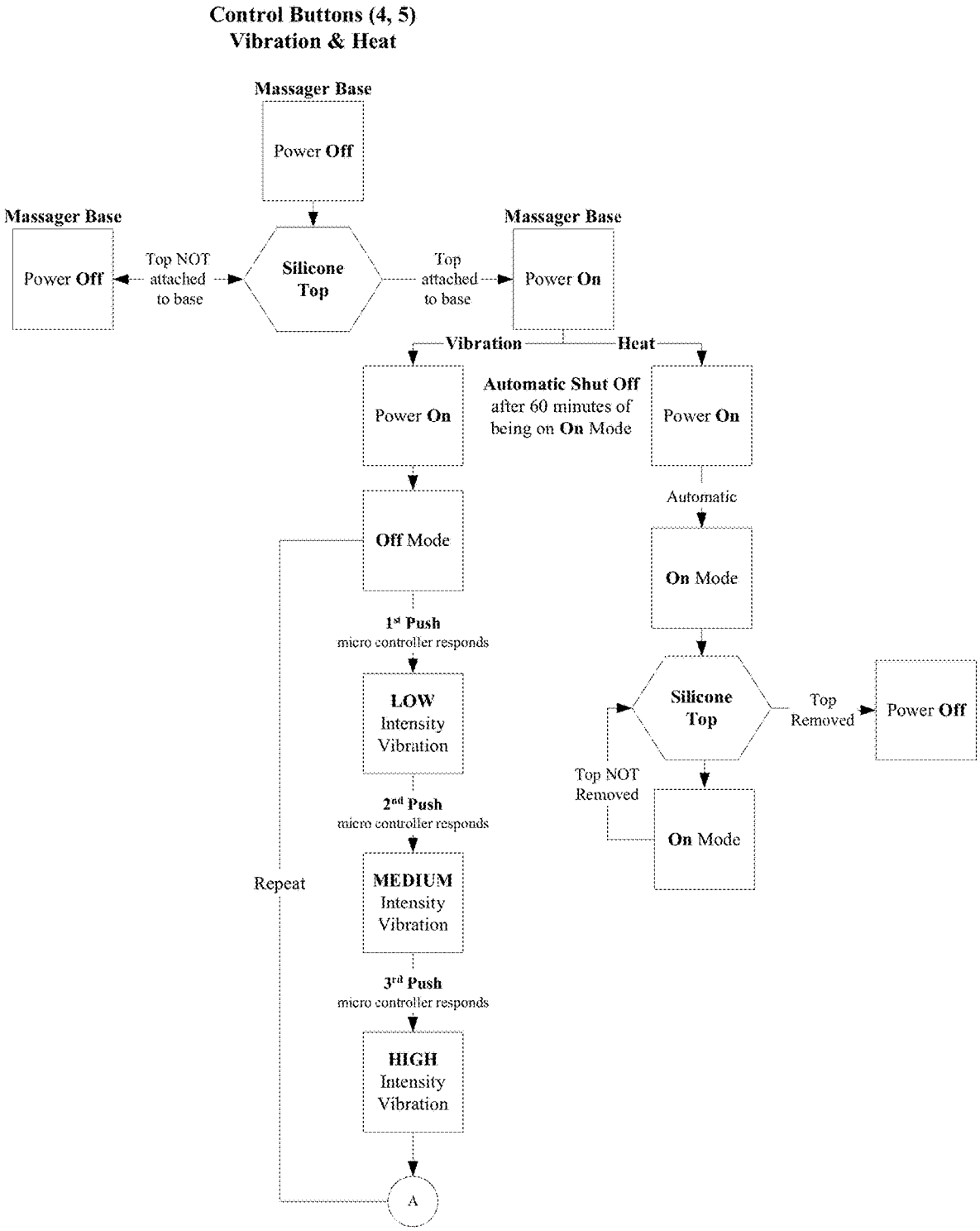
FIG. 9 is a flowchart of the button press sequence(s) when the massager base is used with a removable shell/top.
Figure 9:
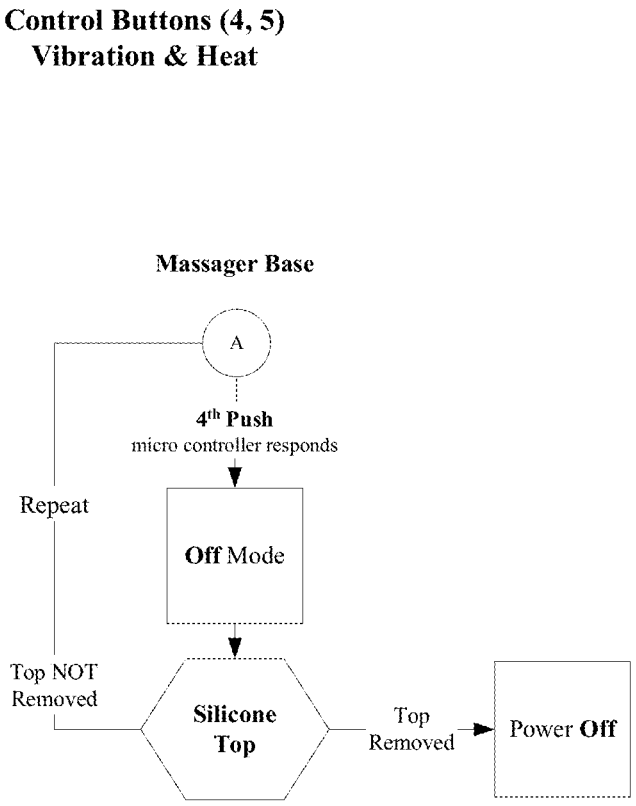

With reference to FIG. 9, an embodiment is shown wherein the buttons 4, 5 will power on only when a silicone molded top shell is attached to massager base 100. In other words, the massager base 100 and its vibrating and heating elements are functional only when connected with a removable and interchangeable top shell 200. The massager base 100 will remain in power off mode when not in contact with an interchangeable shell 200. From the off mode, the micro controller switches to a power on mode when massager base 100 is connected with interchangeable shell top 200 at which time will respond to a push of the button 4, 5 by activating a low intensity motion, of the motor while a second push commands the intensity to medium, followed by a high intensity for the third push. At high intensity, the micro controller responds to a fourth push by returning the motor off. The massager base 100 returns to a power off mode only when silicone shell 200 is disconnected. The heating feature preferably operates without use of a button but rather automatically turning on when massager base 100 is connected with a silicone shell 200 through use of one or two heater boards 11, 12, and are also connected to the processor board 10.

Preferably, there is one heater board 12 located directly beneath the centered depression 3 of the massager base 100. The heat conductor located beneath the centered depression 3 is exposed with only a thin layer of material, preferably metal, designed for enabling direct connectivity as well as penetrating heat through the centered depression 3 of the silicone top 200. Without a silicon shell 200, the massager base 100 will not power on. This function is deliberate and acts as a safety feature to prevent burns or discomfort due to the thin layered heat conductor exposed when held without silicone shell 200 attached. Heating can vary or stay constant. The preferred embodiment remains at a constant temperature of 45° C. The heater boards contain controls to limit their top temperature to 45° C. Such controls are known in the art and the exact means of control is not critical; any heat control will suffice. As referenced in FIG. 9, from the off mode, the micro controller switches to a power on mode, automatically activating heat, when massager base 100 is connected with a silicone shell 200 and will remain on until silicone shell 200 is disconnected, at which time, the massager base 100 and its micro controller returns to off mode. The heat is focused or concentrated preferably within the centered depression 3 of the massager base 100 but leaves the rest of the body of the device cool, or at ambient temperature. An alternate embodiment includes a second heater board 11 located in the narrow end 1 for distributing even heat throughout the device but it is not critical in the design. FIG. 9 summarizes the activation sequences. As noted, it is possible to perform these functions with a single button to cycle though all possible vibration and/or heat combinations (i.e. first press activates first level of vibration, second press activates first vibration and heat, third press activates second level of vibration and disables heat, fourth press activates second vibration level and heat etc.). Connectivity between the massager base 100 and each silicone shell 200 preferably occurs with contact between the massager base's 100 depression 3 and the silicon top's 200 underside of depression embellishment 20 as referenced in FIG. 8 as is designed to be a built-in safety feature as mentioned above.

The bottom 6 has a convex design shape for a comfort fit inside palm while housing any conventional DC power source. The power source 8 is not critical and can be any known in the art, such as three AA batteries, a rechargeable battery, or wireless.

The bottom 6 may contain a mechanism for attaching a wristband/cord, or other tether, which may take the form of two small holes for threading or a flush screw for fastening. The length of the cord is not critical; ½ inch or less is preferred.

With reference now to FIG. 5 there is shown the internal structure and battery 8 compartment. Internal structure includes motor and counter weight 9, heater boards 11, 12 composed of resistive elements that contain temperature protection circuitry, and a processor board 10 with micro controller in which the motor 9, heater boards 11, 12 and battery 8 compartment are directly soldered.

FIG. 6 shows the inside of the upper half of the body of the device. The wide end heater 12 can be seen affixed to the inner surface. Also shown is the vibrator motor housing 9A. The controller 10 can be seen attached to the wall of the wide end 2. This is an alternate location for the controller. The location of the controller is not critical and can be located in numerous places.

FIG. 7 shows a cross section of the device. The wide end heater 12 can be seen near the top, close to the depression 3. Also visible are the vibrator motor housing 9A, controller 10, and power source 8. Vibrator motor 9, and narrow end heater 11 are not shown.

The vibrating and heating massager base 100 is coated (or molded out of) a thin, bio-compatible material, for example, from silicone or a thermoplastic elastomer (TPE). The coating may be of varying thickness providing different levels of firmness or softness around the body of the device.

The described embodiment, with its versatile shape, is designed for use with interchangeable silicone tops/shells 200 and a versatile textile hand coverlet 300, but is not limited to only these arrangements. Moreover, the massager base can be used alone, used with the silicone shell(s), used with the coverlet, or all used together.

The illustrated embodiment, personal massager 100 can take different aesthetic and/or functional shapes or forms, for example, forms which are larger or smaller in scale or forms which incorporate different colors or surfaces. The illustrated embodiment currently presented, provides a more discreet appearance by resembling a common household object, the computer mouse, while offering a chic and multifunctional purpose.

Silicone Molded Top Shell

Figure 8:
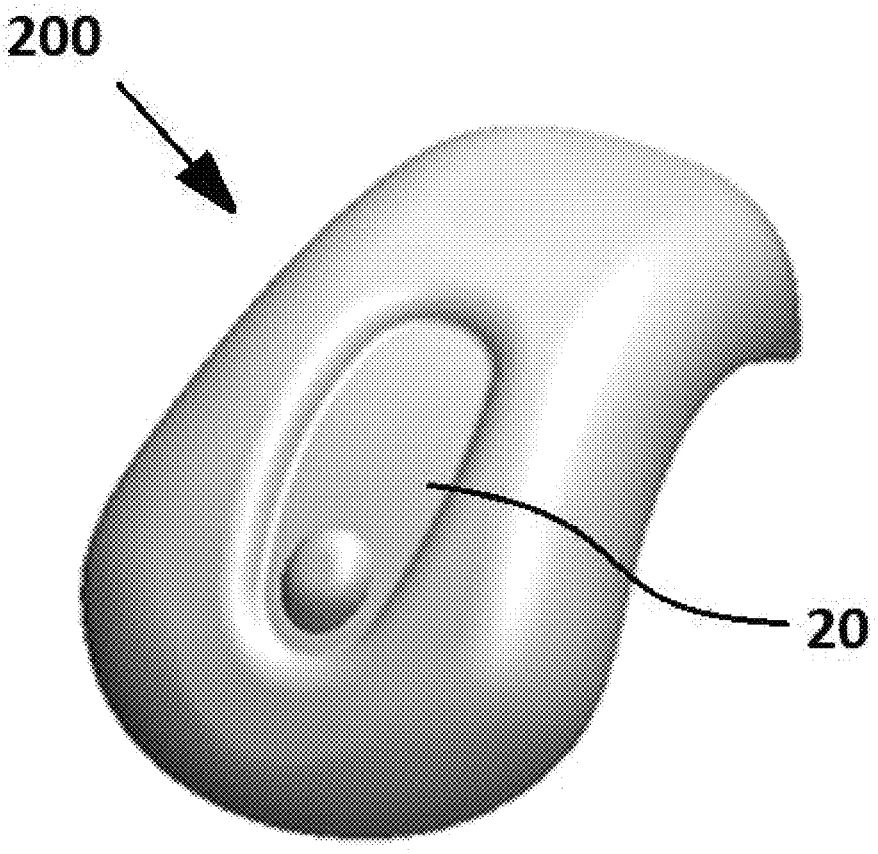
FIG. 8 is a perspective view of an interchangeable shell/top for the massager base.

As noted above, the massager base can accept interchangeable silicone shells 200 (FIG. 8). FIG. 8 shows a shell 200 with a surface having a particular texture, but as will be discussed below, the surface can any number of shapes or textures designed for stimulation. In other words, the texture of the shell 200 is not limited to the texture shown in FIG. 8, but can be, without limitation, the textures in FIGS. 8A, 8B, and/or 8C, or others.

Figure 8A:
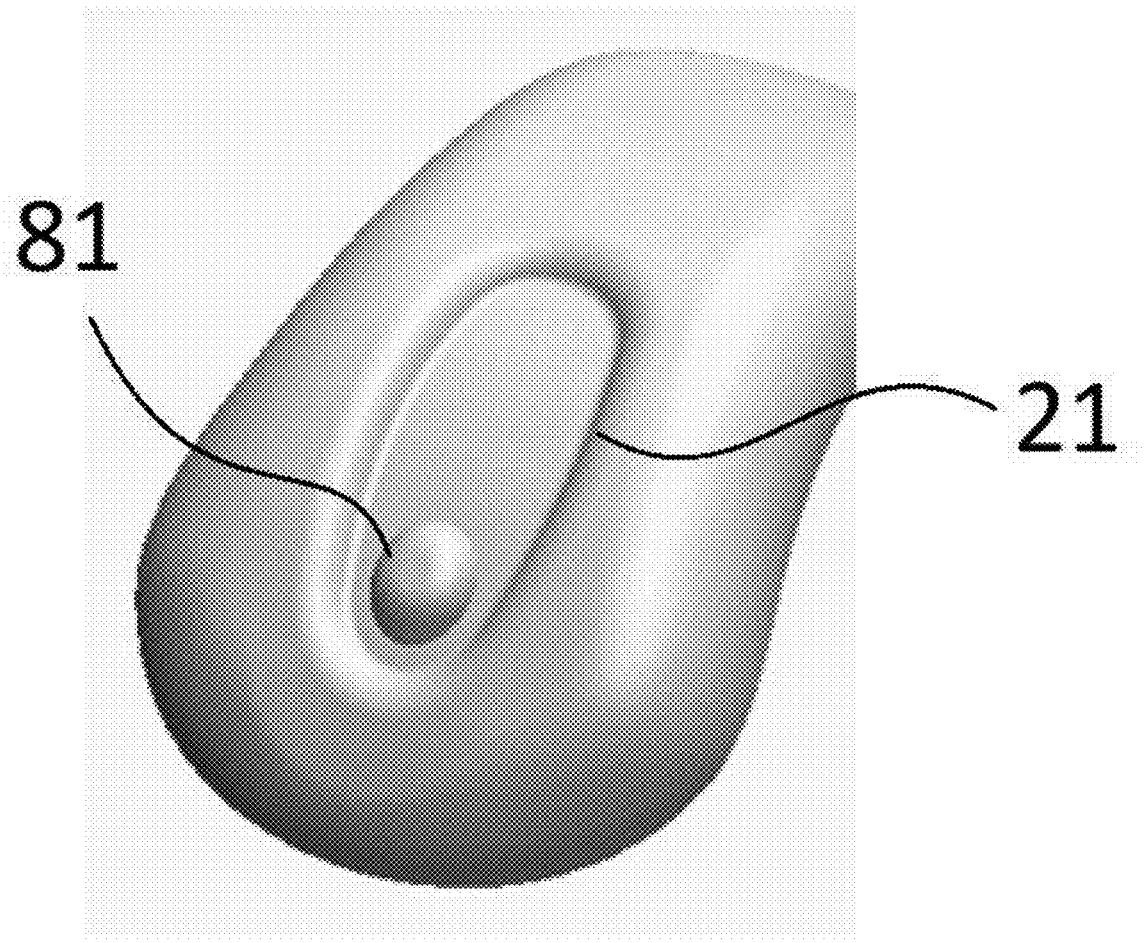
FIG. 8A is a perspective view of an embodiment of an upper surface for stimulation.
Figure 8B:
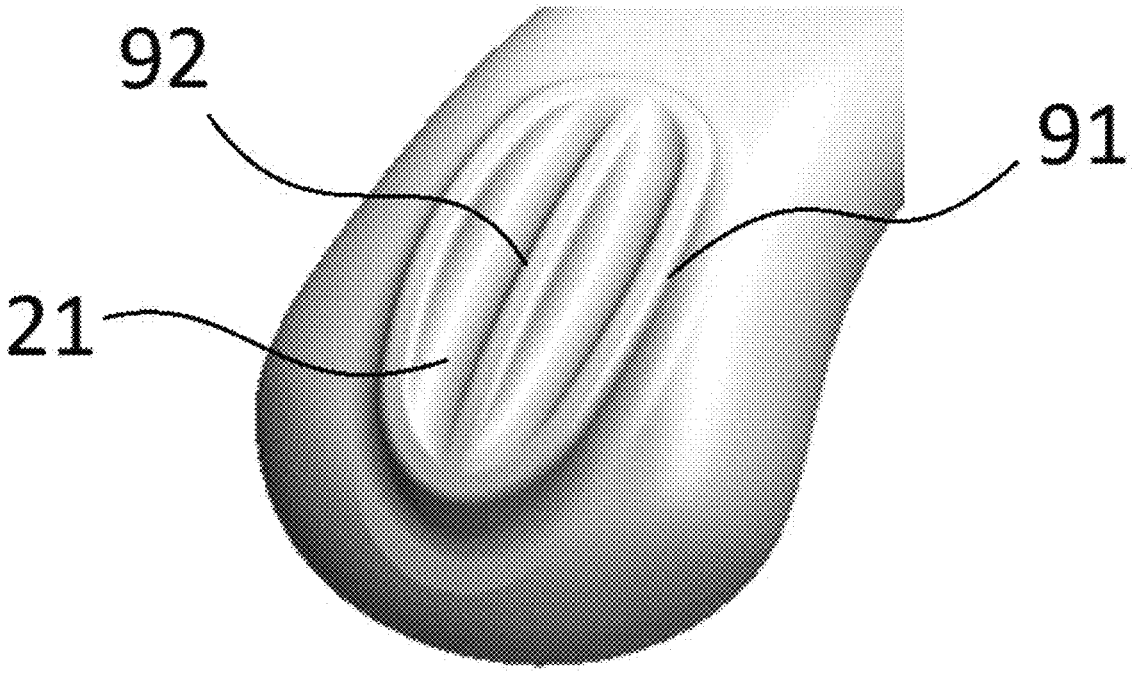
FIG. 8B is an alternate embodiment of the surface shown in FIG. 8A.
Figure 8C:
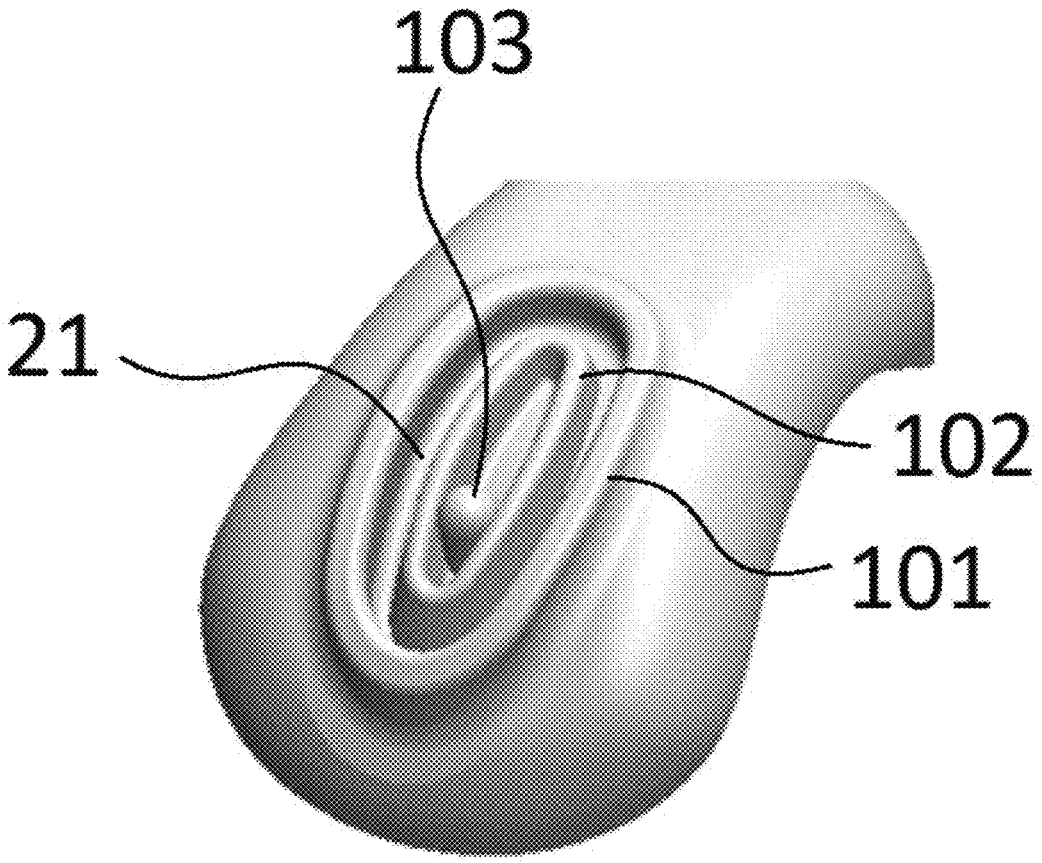
FIG. 8C is an alternate embodiment of the surfaces shown in FIGS. 8A and 8B.

With reference to FIGS. 8A, 8B, and 8C, there are shown three (3) variations of the stimulation surfaces of present invention. These silicone shells/upper portion/tops 200 include designs that reflect the parallel opposite or inverted shapes reflective of three (3) common variations of the female's external anatomy shape and size. Any of the silicone shells/upper portions/tops can be molded into the design of the massager base itself, or formed as a separate shell that can be affixed to, and detached from, a common massager base unit (See, e.g. FIGS. 1A and 4A). In other words, the massager can have the molded silicone shapes as part of the massager, or they can be interchangeable shells for a standard base vibrator/massager. The three (3) preferred variations in the shapes and sizes of the stimulation surfaces are identified through their unique design embellishments located in the centered depression 21. These unique embellishments are distinctly recognized as three (3) variations identified here forth as size tight (FIG. 8A), size typical/average (FIG. 8B), and size loose (FIG. 8C). The first variation as seen in FIG. 8A, identifies the first size as tight showing minimal recesses and protrusions for providing additional stimulation to a female anatomy whose characteristics can be described as compact, firm and fitted. The slight ridges and recessions set forth in size tight provides minimal force to critical pressure points for clitoral stimulation against a female's anatomy who's clitoris is more exposed (i.e. small labia), or petite in size. An anatomy with these characteristics generally require less force against pressure points to experience strong stimulation. The slight circular hemispheric bump/knob 81 (see also FIGS. 1A, 4A) shown within the centered depression 21 (see also depression 3, FIGS. 1A, 4A) provides adequate pressure to a clitoris small in stature and easily accessible.

The second variation as seen in FIG. 8B shows an average/medium size with embellishments more intense then seen in size tight in regards to the severity of dimensions in the ridges and depressions. The outer ridges 91 along the centered depression's 21 circumference are more defined and raised significantly to accommodate a larger size anatomy. Unlike the circular knob 81 shown in FIG. 8A, the interior protrusion 92 in size medium is an elongated fin and elevated significantly to provide adequate force to pressure points desired for clitoral stimulation against a female's anatomy that is categorized as average size. This shape anatomy can be described as one that is not taut but also not considered baggy or loose. Usually with age, especially after vaginal childbirth, the female external anatomy becomes more slack or unrestricting (i.e. loose labia and clitoris) causing more elasticity while impeding the natural exposure of the clitoris from the labia. The defined ridges 91, 92 in size average within the centered depression 21 provides adequate force against an anatomy that is larger in size and restricted in access.

The third variation as seen in FIG. 8C shows size loose with profound embellishments significantly more intense in thickness and peak within, and surrounding, the centered depression 21 when compared to the first two established sizes. The intense contours as seen in size loose are specifically designed for pronounced genital characteristics of being large, limp and with much elasticity. There are multiple layers of outer ridges 101 varying in thickness and depth for creating a graduation effect that assists with separating the labia from clitoris while providing maximum force against pressure points for greater stimulation. Within the outer ridges 101, lie a set of inner ridges 102 and protruding circular bump 103 within the centered depression 21. Combined, these plurality of concentric ridges 101, 102 provide ample pressure to a generously proportioned clitoris while separating sizeable labia for maximum stimulation.

The preferred embodiment uses a combination of silicone, plastic and a heat conductor positioned on the underside of depression 21 but may also include other features necessary for maximizing functionality and ensuring safety.

The underside of centered depression 21 of silicone top 200 conforms to the outer contours of massager base 100 while the exterior surfaces, as described above, include depressions and raised surfaces that provide maximum stimulation customized for varying shapes and sizes of the female external anatomy.

As previously mentioned, connectivity between the massager base 100 and each silicone shell 200 preferably occurs with direct contact between the massager base's 100 depression 3 and the silicon removable shell 200 underside of depression 20 as referenced in FIG. 8. The functionality of powering on only if connectivity between massager base 100 and silicone removable shell 200 is an added safety feature designed to prevent harm or discomfort from touching heat conductor with the bare hand. The illustrated embodiment, silicone interchangeable shells 200 can take different aesthetic and/or functional shapes or forms, for example, forms which are larger or smaller in scale or forms which incorporate different colors or surfaces.

Textile Hand Coverlet

Figure 10:
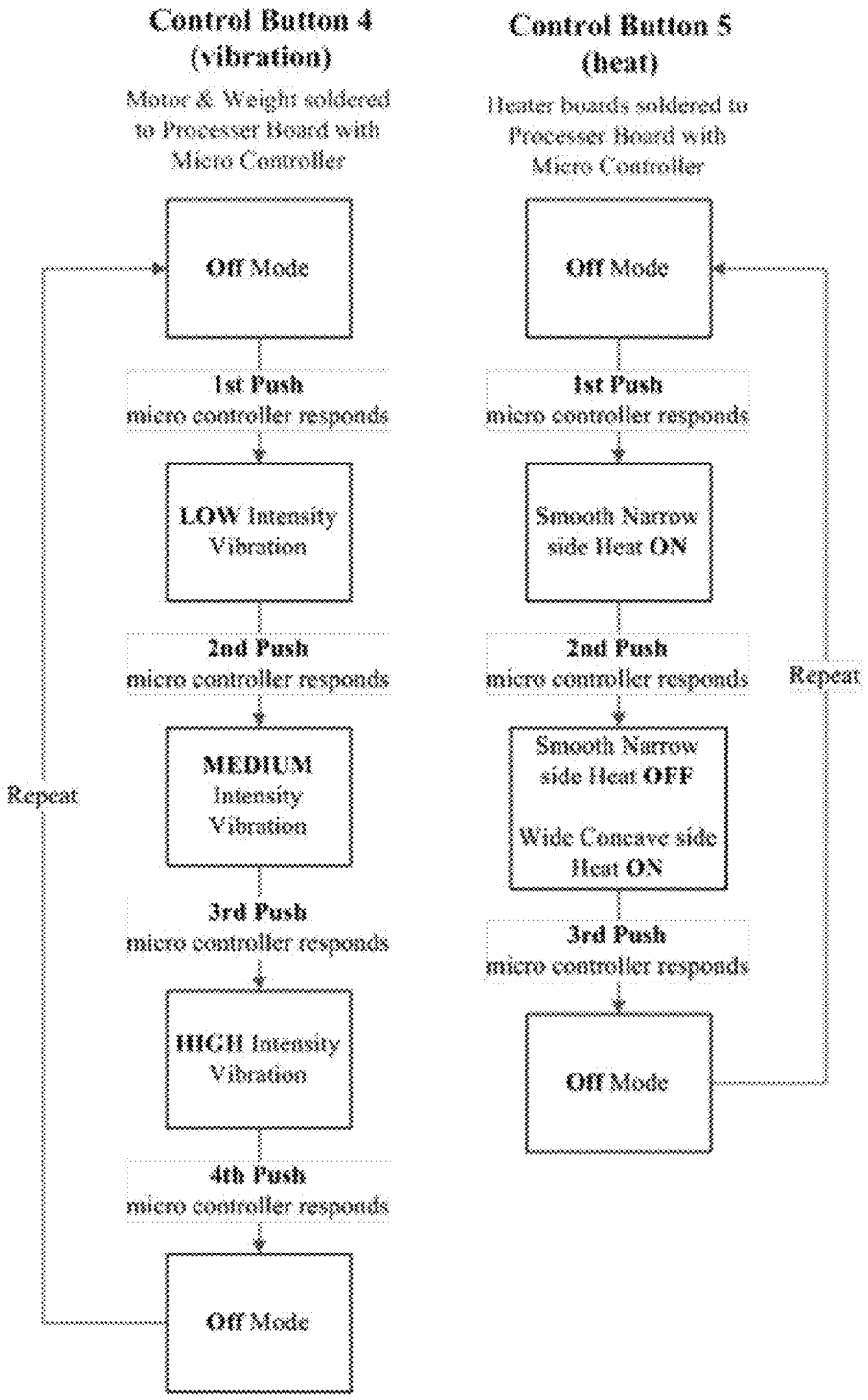
FIG. 10 is a flowchart of the button press sequence(s) when the massager does not require a removable shell/top.
Figure 11:
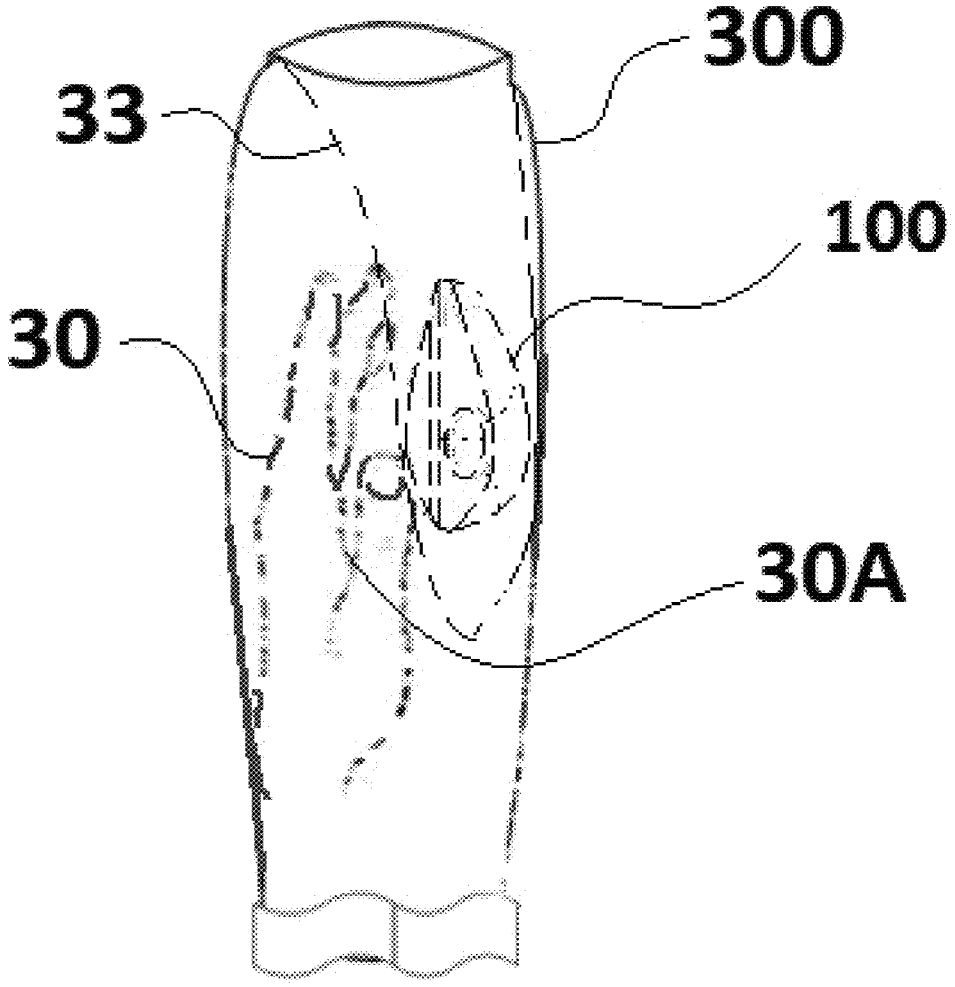
FIG. 11 is a side view of the textile hand coverlet showing the user's hand and the massager within.
Figure 12:
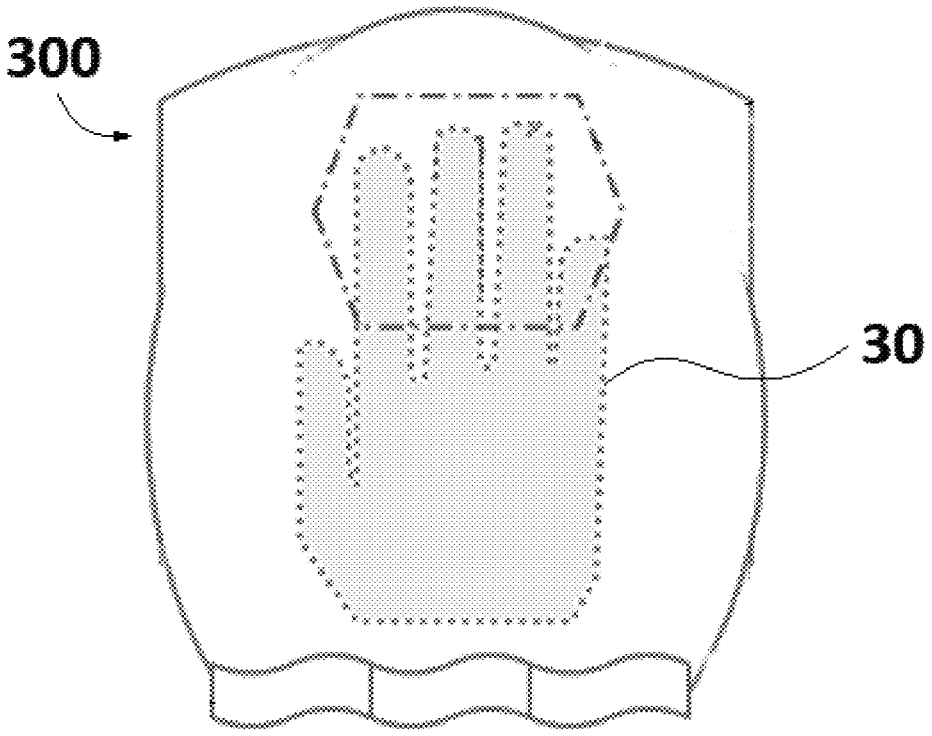
FIG. 12 is a top view of the textile hand coverlet showing the user's hand within.

With reference now to FIGS. 10, 11 there is shown the cloth textile hand coverlet 300. The coverlet 300 is generally a fingerless cover to shroud the user's hand 30 and massager base 100 with silicone top 200. It can include a pocket or other means to separate and physically segregate the hand 30 from the massager, preferably constructed with a built-in pocket 33 designed to hold the vibrating and heating massager base 100 with silicone shell 200. As used herein, the term "fingerless cover" in intended to describe a pouch with room for the user to insert her hand, and includes a mitt (no separate fingers/thumb) and a mitten (separate thumb, no fingers).

Access to pocket 33 may come from either inside or outside the cover. It further may or may not include some form of closure mechanism (i.e. zipper, Velcro, snaps, button, string/ribbon/bow, etc., or none at all). The pocket 33 is constructed such that the massager base 100 with silicone interchangeable shell 200, 502 lines up with the hand 30 when both are inserted into the hand coverlet 300. The coverlet 300 can be constructed without a pocket, requiring the user to hold the massager base 100 with silicone shell 200 directly in the palm 30A while placing the textile coverlet 300 over the hand 30 holding the massager apparatus.

The exact dimensions of the coverlet 300 are not critical. The preferred embodiment, measures approximately 9.25 inches in length and 7.5 inches in width, which provides sufficient room to comfortably fit a woman's hand 30 in most cases. The textile hand coverlet 300 may also take form of a tailored slip-on cover that is designed to go over the massager apparatus directly. All cover versions are constructed out of anti-bacterial, treated machine washable fabrics, thread, preferably silk thread, elastic band, preferably ½ inch thick elastic band, and decorative lace and trim. The coverlet 300 is constructed using an industrial serger and embroidery machine and consists of main components such as back side pattern made from anti-bacterial treated machine washable fabric, palm side pattern made from anti-bacterial treated machine washable fabric, inside lining pattern made from anti-bacterial treated machine washable fabric, textile can be constructed from a variety of different materials for each separate coverlet 300. These textiles include, but are not limited to, cotton, cotton blends, vinyl, vinyl with texture, polyester, polyester blends, corduroy, silk, and fleece, elastic band, and ribbon and/or trim that comes in different shapes, sizes, and textiles.

The outside textile provides versatility in sensations and enhances the vibration and stimulation experience. The various textures provide sensations that include, but are not limited to, soft and velvety, smooth and silky, rough and bumpy, slick and even prickly. Use of lubricants can also be used and are best applied to the smooth and silky textiles. This applique can be of any shape, including but not limited to, square, circle, triangle, polygon, heart, club, diamond, spade, chevron, oval, ellipse, fleur de lis, and combinations thereof.

In lieu of a hand coverlet format, the versatile textiles may also come in the form of a removable tailored slip cover that fits snug around the massager base 100 with silicone shell 200. The slip cover provides a less bulky alternative yet allows for the same versatility and enhancement of sensations.

In the illustrated embodiment, textile hand coverlet 300 can take different aesthetic and/or functional shapes or forms, for example, forms which are larger, smaller in scale, with thumb or fingers in any combination or forms which incorporate different colors or textiles. The textile hand coverlet 300 provides instant softness and warmth when used in conjunction with the vibrating personal massager, and allows the user with a sense of discretion and comfort not typically associated with traditional prior art. The hand coverlet 300, designed to fully conceal the hand 30 and the pubic area, can provide relief of psychological discomfort and guilt associated with self-stimulation. While the hand 31 is concealed, the act of masturbation becomes less visually obvious, which can make the act feel less dirty, sinful, and/or offensive.

Dual-Module Massager

Figure 13:
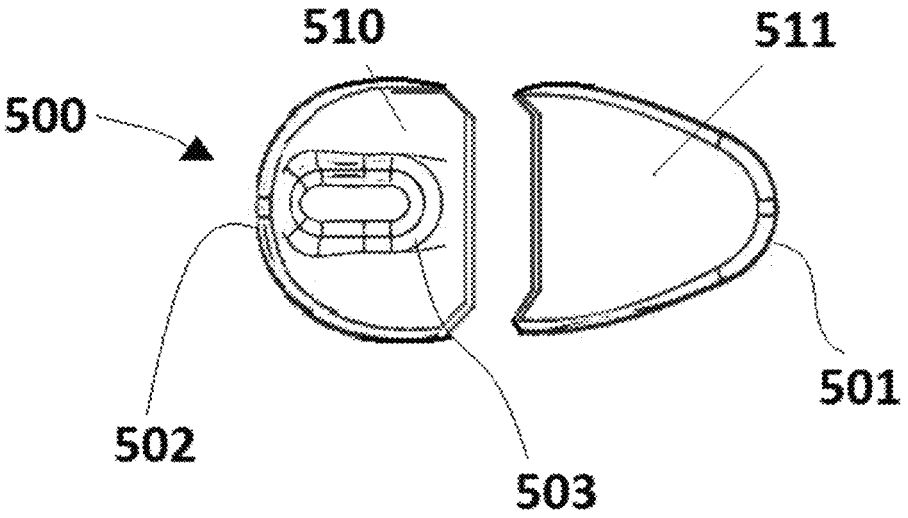
FIG. 13 is a top view of an alternate embodiment of the massager shown in FIG. 1.
Figure 14:
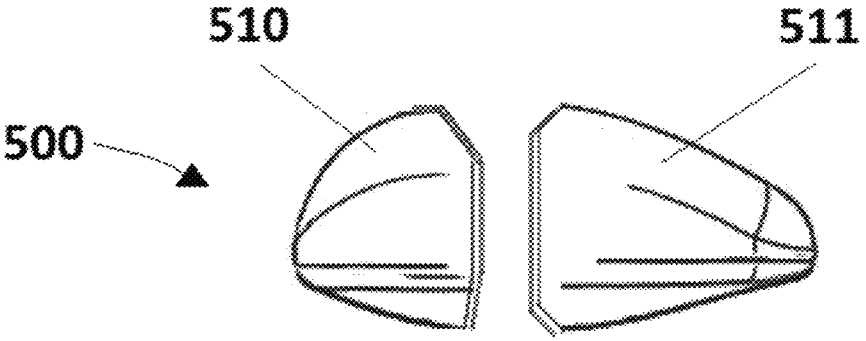
FIG. 14 is a side view of the massager shown in FIG. 13.

Another embodiment is shown in FIGS. 13 and 14, featuring a 2-piece/dual module massager 500. The dual module massager 500 is formed from a control module 511 and a stimulation module 510. The control unit 511 houses the power supply, controls, and circuit board with connection capabilities to stimulation module 510. The stimulation unit/working module 510 contains the vibration means and the textured stimulation surfaces (See FIGS. 8A, 8B, 8C). The stimulation module 510 can also contain a heating element in addition to the textured stimulation surface. Each stimulation module 510 would have a single stimulation texture, and multiple stimulation modules 510 would be available to interchangeably join with the control module 511. For example, a first stimulation module might have the texture of FIG. 8A, and second stimulation module would have texture from FIG. 8B, and a third with the 8C texture. Moreover, a fourth module could have the texture of FIG. 8A and a heating element, a fifth module with the 8B texture and heating element, etc.

This embodiment has many of the same features of the other massagers discussed above. For instance, it features a smooth narrow end 501 and a wide end 502 shaped with a vertical concave cup or crater-like depression 503. As with the massager base 100 being functional only when connected with a removable and interchangeable top shell 200, in a similar way, the massager 500 and its vibrating and heating elements are functional only when both modules 501, 502 are connected.

While the invention has been shown and described with respect to particular embodiments, it is not thus limited. Numerous modifications, changes and improvements, within the scope of the invention, will now be apparent to the reader.

What is claimed is:

1. A hand-held, non-penetrating, non-phallic shaped apparatus for clitoral massage and stimulation comprising:

a massager housing having a generally prolate spheroid shape sized to fit entirely within a user's palm leaving a user's fingers free, generally convex top and bottom, first and second convex ends, a power source;

a vibrating source contained within the massager housing providing at least one level of vibration;

at least one switch for activating said vibration;

a generally elliptical three-dimensional concave depression on a surface of the convex top of one of said convex ends of sufficient length, width, and depth for enveloping and facilitating the stimulation of a woman's clitoris and labia;

wherein when in use the apparatus is held by the bottom;

wherein the apparatus further includes a contoured shell that attaches to said massager housing, wherein the shell has an interior surface geometry and the massager housing has an exterior surface geometry, wherein the interior surface geometry matches and removably attaches to the exterior geometry of the massager housing;

wherein said contoured shell has an exterior surface, wherein said exterior surface has one or more protrusions shaped to engage and stimulate a user's clitoris;

wherein said protrusion on said shell comprises a generally elliptical three-dimensional concave depression on a surface of said housing of sufficient depth for enveloping a woman's clitoris and labia, with a generally convex protrusion on a surface within said concave depression of sufficient height for providing force against a woman's clitoris.

2. The apparatus of claim 1, wherein said first end is narrower than said second end.

3. The apparatus of claim 1, further comprising a heating source contained within the massager housing providing concentrated heat penetrable through housing material to the elliptical depression on the massager's surface while leaving the remainder of the apparatus at ambient temperature.

4. The apparatus of claim 1, wherein said elliptical depression has a major axis, and wherein said prolate spheroid has a major axis, and wherein both of said major axes are coplanar.

5. The apparatus of claim 1, wherein said convex protrusion is selected from the group consisting of a hemispheric bump, a fin, and a plurality of concentric ridges, and combinations thereof.

6. The apparatus of claim 1, wherein said contoured shell is composed of silicone.

7. The apparatus of claim 1, further comprising active noise control to reduce the volume of the vibrating source.

8. A textile hand coverlet comprising;

a cylindrical textile pouch having first and second opposing longitudinal openings;

a pocket sized to hold the massager of claim 1;

wherein said first opening is sized to accommodate a user's hand;

wherein said second opening provides sole access to said pocket; and wherein said first and second openings are separate, distinct openings.

9. A non-penetrating, non-phallic shaped apparatus for clitoral massage and stimulation comprising:

a control module and a stimulation module;

wherein when the control module and stimulation module are joined together, they have a generally prolate spheroid shape sized to fit entirely within a user's palm leaving a user's fingers free, generally convex top and bottom, first and second convex ends, wherein the control module comprises a power source, at least one switch;

wherein said stimulation module comprises a vibrating source contained within a housing of the stimulation module providing at least one level of vibration controlled by said switch, a generally elliptical three-dimensional concave depression on a surface of one of the convex ends and of sufficient length, width, and depth for enveloping a woman's clitoris and labia with a generally convex protrusion on a surface within said concave depression of sufficient height for providing force against a woman's clitoris.

10. The apparatus of claim 9, wherein said convex protrusion is selected from the group consisting of a hemispheric bump, a fin, and a plurality of concentric ridges, and combinations thereof.

11. The apparatus of claim 9, wherein said first end is narrower than said second end.

12. The apparatus of claim 9, further comprising a heating source contained within the stimulation module providing concentrated heat penetrable through housing material to a localized site on a surface of the massager while leaving the remainder of the apparatus at ambient temperature.

* * * * *